US009110410B2

(12) United States Patent
Yamaguchi et al.

(10) Patent No.: US 9,110,410 B2
(45) Date of Patent: Aug. 18, 2015

(54) IMAGE FORMING APPARATUS INCLUDING A BELT UNIT AND AN URGING MEMBER

(75) Inventors: Wataru Yamaguchi, Nisshin (JP); Shigeki Hayakawa, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 238 days.

(21) Appl. No.: 13/307,248

(22) Filed: Nov. 30, 2011

(65) Prior Publication Data

US 2012/0134727 A1 May 31, 2012

(30) Foreign Application Priority Data

Nov. 30, 2010 (JP) ..... 2010-266160

(51) Int. Cl.

*G03G 15/00* (2006.01)
*G03G 15/16* (2006.01)
*G03G 21/16* (2006.01)

(52) U.S. Cl.

CPC ..... *G03G 15/167* (2013.01); *G03G 15/168* (2013.01); *G03G 21/1642* (2013.01); *G03G 21/1647* (2013.01); *G03G 21/1695* (2013.01); *G03G 2215/00139* (2013.01); *G03G 2221/1654* (2013.01); *G03G 2221/1684* (2013.01)

(58) Field of Classification Search

CPC ..... G03G 2215/00139; G03G 2221/16; G03G 2221/1615; G03G 2221/1654; G03G 2221/1684; G03G 2215/0054; G03G 21/1642; G03G 21/1647; G03G 21/1695; G03G 2221/1672

USPC ..... 399/121, 124, 388, 107, 110, 303, 312, 399/162–165

See application file for complete search history.

(56) References Cited

U.S. PATENT DOCUMENTS 6,920,291 B2 * 7/2005 Saitoh et al. ..... 399/49
7,577,380 B2 * 8/2009 Mori ..... 399/121
2003/0223784 A1 12/2003 Yamanaka et al.

(Continued)

FOREIGN PATENT DOCUMENTS

JP 04307577 A * 10/1992 ..... G03G 15/20
JP 2000039820 A * 2/2000 ..... G03G 21/10

(Continued)

OTHER PUBLICATIONS

Dec. 24, 2013 Office Action issued in Japanese Patent Application No. 2010-266160.

(Continued)

*Primary Examiner* — Daniel J Colilla
*Assistant Examiner* — Justin Olamit
(74) *Attorney, Agent, or Firm* — Banner & Witcoff, Ltd.

(57) ABSTRACT

An image forming apparatus is provided which includes a main body, and a belt unit removable from the main body. The belt unit includes a belt extending between a drive roller and a driven roller and configured to rotate such that a recording medium is fed in a feeding direction. The apparatus further includes a feeding device that feeds the recording medium to the belt, and a positioning section including an engaging portion and an engaged portion, the positioning section being configured to position the belt unit when the engaging portion engages the engaged portion. Also, an urging member is provided that urges the belt unit and causes a pressing force to be applied between the engaging portion and the engaged portion. An urging direction of the urging member has a component in the feeding direction.

15 Claims, 5 Drawing Sheets

(56) References Cited

U.S. PATENT DOCUMENTS

| | | | | |
|---|---|---|---|---|
| 2005/0084294 | A1 | 4/2005 | Mizushima et al. | |
| 2006/0222401 | A1 | 10/2006 | Kamimura | |
| 2007/0048005 | A1 | 3/2007 | Nakano et al. | |
| 2007/0048010 | A1 * | 3/2007 | Nakano | 399/121 |
| 2011/0076051 | A1 | 3/2011 | Murayama | |

FOREIGN PATENT DOCUMENTS

| | | | | |
|---|---|---|---|---|
| JP | 2000-275987 | A | | 10/2000 |
| JP | 2003-084531 | A | | 3/2003 |
| JP | 2005-077774 | A | | 3/2005 |
| JP | 2006-276447 | A | | 10/2006 |
| JP | 2007-057952 | A | | 3/2007 |
| JP | 2007-065556 | A | | 3/2007 |
| JP | 2008070482 | A | * | 3/2008 |
| JP | 2010-217525 | A | | 9/2010 |
| JP | 2011-075618 | A | | 4/2011 |

OTHER PUBLICATIONS

Decision of Final Rejection dated Jul. 15, 2014, issued in corresponding Japanese Patent Application No. 2010-266160.

* cited by examiner

IMAGE FORMING APPARATUS INCLUDING A BELT UNIT AND AN URGING MEMBER

CROSS REFERENCE TO RELATED APPLICATION

This application claims priority from Japanese Patent Application No. 2010-0266160, filed on Nov. 30, 2010, the content of which is incorporated herein by reference in its entirety.

TECHNICAL FIELD

Aspects of the disclosure relate to an image forming apparatus including a belt unit.

BACKGROUND

A known image forming apparatus may include a belt unit configured to feed a recording medium. The belt unit may mainly include a drive roller, a driven roller, a belt extending between the drive roller and the driven roller, and a frame supporting the rollers rotatably. The frame of the belt unit is positioned such that an engaging portion provided to the frame is urged by an urging means and pressed against an engaged portion provided to a main body of the image forming apparatus, frontward of the main body. The image forming apparatus is configured such that a recording medium is fed in a direction opposite to an urging direction of the urging means.

However, in the above art, when the recording medium is fed onto the belt, a frictional resistance between the recording medium and the belt is produced because the recording medium is fed in the direction opposite to the urging direction. As a result, the urging means may be deformed, which may destabilize positioning of the belt unit.

SUMMARY

Aspects of the disclosure may provide an image forming apparatus configured to stabilize positioning of a belt unit.

According to an aspect of the disclosure, an image forming apparatus comprises a main body, a belt unit, an image forming unit, a feeding device, a positioning section, and an urging member. The belt unit is configured to be attached to and removed from the main body, and includes a drive roller, a driven roller, and a belt extending between the drive roller and the driven roller and being configured to rotate such that a recording medium is fed in a feeding direction. The image forming unit is disposed to contact a flat surface of the belt and configured to form an image on the recording medium. The feeding device is configured to feed the recording medium to the belt. The positioning section includes an engaging portion and an engaged portion. The positioning section is configured to position the belt unit when the engaging portion engages the engaged portion. The urging member is configured to urge the belt unit and cause a pressing force to be applied between the engaging portion and the engaged portion. An urging direction of the urging member has a component in the sheet feeding direction.

BRIEF DESCRIPTION OF THE DRAWINGS

Illustrative aspects of the disclosure will be described in detail with reference to the following figures in which like elements are labeled with like numbers and in which.

DETAILED DESCRIPTION

An illustrative embodiment of the disclosure will be described in detail with reference to the accompanying drawings.

A general structure of an image forming apparatus, e.g., a color printer 1, will be described.

Figure 1:
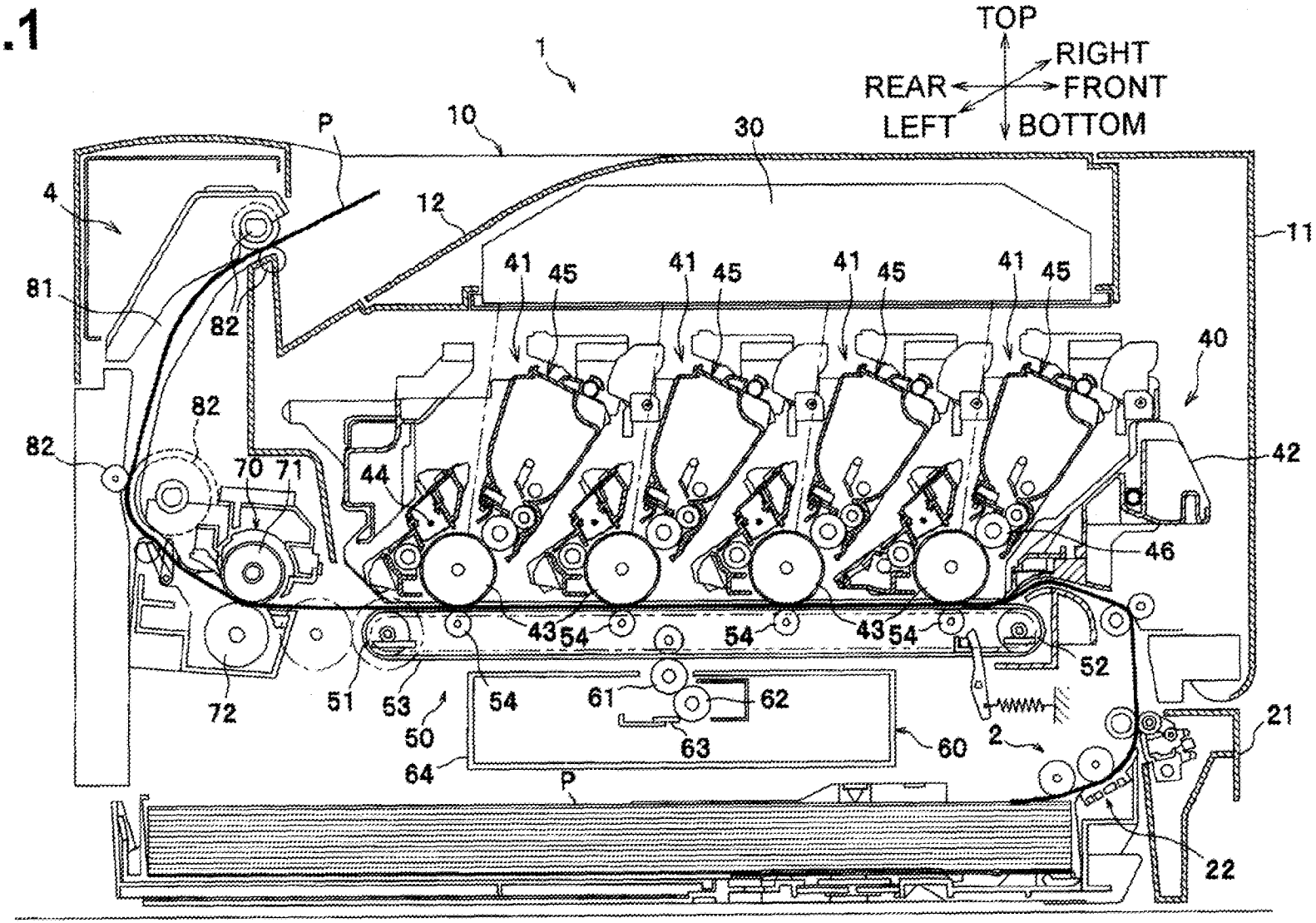
FIG. 1 is a sectional view schematically illustrating an image forming apparatus according to an illustrative embodiment.

In the following description, directions are referred when the color printer 1 is viewed from a user in front of the color printer 1. In FIG. 1, the right side of the drawing is referred to as the front or front side of the color printer 1, and the left side of the drawing is referred to as the rear or rear side of the color printer 1. When the color printer 1 is viewed from the front side, the left side is referred to as the left or left side, and the right side is referred to as the right or right side. The directions, front, rear, left, right, top, and bottom, shown in each drawing are referenced based on the directions shown in FIG. 1.

As shown in FIG. 1, the color printer 1 may include, in a main body 10, a sheet supply unit 2, an exposure unit 30, an image forming unit 40, a belt unit 50, a belt cleaner 60, a fixing unit 70, and an ejection portion 4. The sheet supply unit 2 is configured to feed a recording medium, e.g., a sheet P. The sheet P may include a plain sheet, thick sheet, a post card, a thin sheet, and a transparent sheet. The ejection portion 4 is configured to eject a sheet P having an image formed thereon.

The sheet supply unit 2 may be disposed in a lower portion of the main body 10, and may mainly include a sheet supply tray 21 and a feeding device, for example, a sheet supply mechanism 22. The sheet supply tray 21 is configured to store a stack of sheets P. The sheet supply tray 21 may be non-destructively attachable to and removable from the front of the main body 10. The sheet supply mechanism 22 is configured to separate a sheet P from the sheet supply tray 21 and feed the sheet P to a position between the image forming unit 40 and the belt unit 50.

The exposure unit 30 may be disposed in an upper portion of the main body 10, and may include laser light sources, a polygon mirror, lenses, and reflecting mirrors, which are not shown. The exposure unit 30 may have a plurality of, e.g. four, laser light sources, which are provided for four colors of cyan, magenta, yellow, and black. A laser beam emitted from each laser light source, based on image data, may be deflected by the polygon mirror, pass through the lenses, and be folded by the reflecting mirror to be directed to a surface of each photosensitive drum 43.

The image forming unit 40 may be disposed between the sheet supply unit 2 and the exposure unit 30 and may include a plurality of, e.g., four, process units 41, and a supporting member 42 configured to support the process units 41 such that the process units 41 are arranged in line in a front-rear direction.

Each process unit 41 may mainly include a photosensitive drum 43, a charger 44, and a developing cartridge 45. The developing cartridge 45 may mainly include a developing roller 46, a supply roller, a layer-thickness regulating blade, and a toner chamber, which are shown without reference numerals.

The belt unit 50 may be disposed between the sheet supply unit 2 and the image forming unit 40, and may include a drive roller 51, a driven roller 52, a belt 53, and four transfer rollers 54. In this illustrative embodiment, the belt 53 is endless, extends between the drive roller 51 and the driven roller 52, and is configured to rotate around the drive roller 51 and the driven roller 52 such that the sheet P is fed in a sheet feeding direction. The belt 53 is disposed below the image forming unit 40 such that an upper belt 53A of the belt 53 contacts photosensitive drums 43. The transfer rollers 54 are disposed between the drive roller 51 and the driven roller 52 inside the belt 53 so as to face corresponding photosensitive drums 43 via the upper belt 53A. In other words, the upper belt 53A of the belt 53 is sandwiched between the photosensitive drums 43 and the transfer rollers 54. The belt unit 50 may be non-destructively attachable to and removable from the main body 10.

The fixing unit 70 may be disposed downstream from the image forming unit 40 and the belt unit 50 in the sheet feeding direction, and include a heat roller 71 and a pressure roller 71 disposed facing the heat roller 71 and configured to press the heat roller 71.

In the image forming unit 40, the surfaces of the rotating photosensitive drums 43 are uniformly and positively charged by the respective chargers 44, and exposed to laser beams emitted from the exposure unit 30 by high speed scanning. As a result, electrostatic latent images based on image data are formed on the respective surfaces of the photosensitive drums 43.

In each process unit 41, toner stored in the toner chamber is supplied to the developing roller 46 via the supply roller, passes between the developing roller 46 and the layer-thickness regulating blade, and is carried on the developing roller 46 as a thin layer having a uniform thickness. Toner carried on the developing roller 46 is supplied to the electrostatic latent image formed on the photosensitive drum 43. As a result, the electrostatic latent image formed on the photosensitive drum 43 becomes visible, and a toner image is carried on the photosensitive drum 43.

Then, the sheet supply mechanism 22 feeds a sheet P to the belt 53. When the sheet P passes between the photosensitive drums 43 and the belt 53 above the transfer rollers 54, the toner images carried on the surfaces of the photosensitive drums 43 are sequentially transferred and overlaid one on top of the other on the sheet P. When the sheet P having the toner images passes between the heat roller 71 and the pressure roller 72, the toner images are fixed onto the sheet P as an image.

The ejection portion 4 may include a sheet ejection passage 81 and ejection rollers 82. The sheet ejection passage 81 extends upward from an outlet of the fixing unit 70 and then frontward. The ejection rollers 82 are configured to feed a sheet P having an image thermally fixed thereon through the sheet ejection passage 81 toward an output tray 12 provided on an upper surface of the main body 10.

A front side wall of the main body 10 is a front cover 11. The image forming unit 40 and the belt unit 50 can be removed from the main body 10 by opening the front cover 11.

A detailed structure of and around the belt unit 50 will be described with reference to FIGS. 2 and 3.

As described above, the belt 53 extends between the drive roller 51 and the driven roller 52. The upper belt 53A is an upper stretched flat portion of the belt 53, and contacts the photosensitive drums 43 on its outer (upper) surface. During printing, the photosensitive drums 43 contact a sheet P on the belt 53.

In this disclosure, the sheet feeding direction refers to a direction in which a sheet P is fed in a contact position 93P where the sheet P fed by the sheet supply mechanism 22 contacts the belt 53. In this embodiment, the sheet feeding direction is a rearward direction.

To feed a sheet P in the rearward direction, the photosensitive drums 43 rotate in the forward direction with the upper belt 53A of the belt 53. In other words, a portion of each photosensitive drum 43 contacting the upper belt 53A moves rearward in a manner similar to the upper belt 53A.

The photosensitive drums 43 are driven by a drive source, which is not shown. The circumferential velocity of the photosensitive drums 43 is set to be substantially the same as or slightly greater than that of the belt 53. In other words, a force applied by the photosensitive drums 43 to the belt unit 50 in a direction the same as the sheet feeding direction becomes greater than or equal to zero. This force acts in such a way as to press lock pins 55A against corresponding protruding portions 92B, which will be described later. When the circumferential velocity of the photosensitive drums 43 is greater than that of the belt 53, a force acts in such a way that the photosensitive drums 43 move the belt unit 50 in the same direction as the sheet feeding direction.

The drive roller 51 and the driven roller 52 are rotatably supported by a frame 55 of the belt unit 50 via bearings 51A and 52A, respectively. To apply adequate tension to the belt 53, the drive roller 51 and the driven roller 52 are urged by springs (not shown) such as to be spaced apart from each other. Thus, the driven roller 52 is supported by the frame 55 such that the driven roller 52 can slightly move in the front-rear direction.

The frame 55 includes an engaging portion, for example lock pins 55A according to this embodiment. The lock pins 55A are disposed in a front portion of the frame 55 and protrude outward from the left and right sides of the frame 55. The main body 10 includes an engaged portion, for example positioning rails 92 according to this embodiment. The positioning rails 92 are disposed in positions corresponding to the left and right sides of the frame 55 to be attached to the main body 10. The lock pins 55A and the positioning rails 92 are configured to engage each other and comprise positioning sections 100 on the left and right sides. The positioning sections 100 are configured to position the belt unit 50.

Each positioning rail 92 includes a rail portion 92A extending horizontally in the front-rear direction and a protruding portion 92B extending upward from a rear portion of the rail portion 92A. A front surface of the protruding portion 92B is a vertical plane, which is oriented to receive a force that the photosensitive drums 43 press the belt unit 50 in the rear direction. Each lock pin 55A has a length reaching a corresponding positioning rail 92. In other words, each positioning rail 92 has two surfaces extending in directions crossing each other so as to contact the corresponding lock pin 55A from different directions. Thus, when the lock pins 55A are pressed toward the rails 92 by an urging member, the belt unit 50 is positioned in the front-rear direction and vertically.

In this embodiment, lock members 93 and springs 94 serve as an example of an urging member. The lock members 93 and springs 94 are supported by the main body 10 in front of the lock pins 55A. Each lock member 93 includes a first arm 93A, a second arm 93B, and a shaft 93C. The first arm 93A extends upward from the shaft 93C. The second arm 93B extends downward from the shaft 93C. The lock member 93 is pivotable on the shaft 93C which is parallel with the drive roller 51. The second arm 93B engages one end of the spring 94. The other end of the spring 94 engages the main body 10. By the spring 94, the second arm 93B is normally urged frontward and the first arm 93A is normally urged rearward.

The first arm 93A is disposed to contact the lock pin 55A of the belt unit 50 attached to the main body 10, and is configured to urge the belt unit 50 rearward. An urging direction in which the lock member 93 and the spring 94 produce an urging force acting on the belt unit 50 has a component in the same direction as the sheet feeding direction. In other words, an angle formed by the urging direction and the sheet feeding direction is less than 90 degrees. In addition, a component of the urging force in the same direction as the sheet feeding direction may be greater than a half of the urging force. In other words, the angle formed by the urging direction and the sheet feeding direction may be less than 60 degrees.

Owing to this structure, when the color printer 1 is out of service, the lock pin 55A is pressed rearward by the first arms 93A, the belt unit 50 is entirely urged rearward (in the sheet feeding direction), and a pressing force is applied between the lock pin 55A and the protruding portion 92B. Thus, the belt unit 50 is positioned in the front-rear direction.

A belt gear 51C is disposed coaxially with the drive roller 51 on one end, e.g., left end, of a shaft 51B of the drive roller 51. The belt gear 51C engages a main body gear 91 side by side in a direction along the upper belt 53A.

Figure 2:
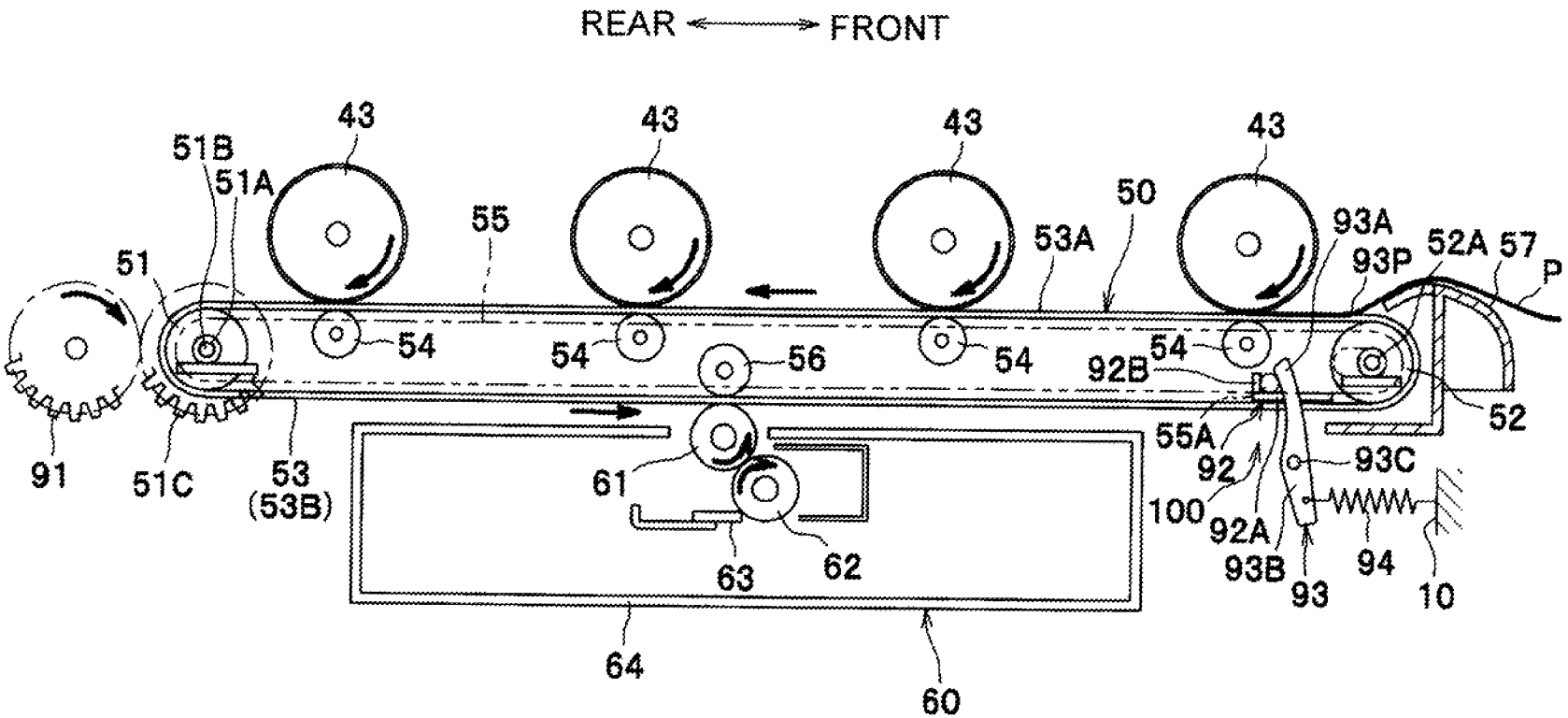
FIG. 2 is a sectional view schematically illustrating a belt unit and peripheral parts.
Figure 3:
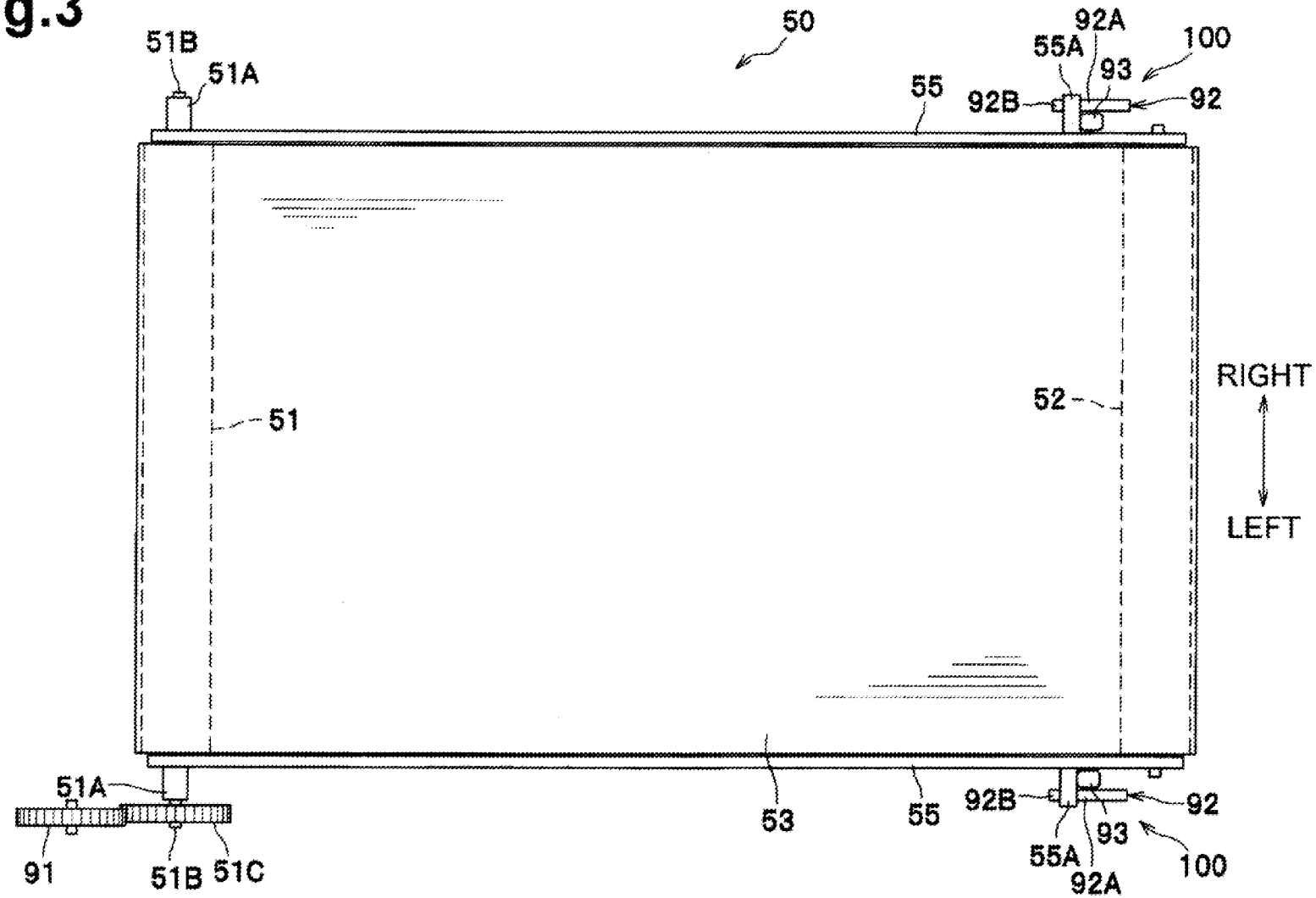
FIG. 3 is a plan view schematically illustrating the belt unit and the peripheral parts.

The main body gear 91 is disposed in the main body 10 and configured to rotate clockwise in FIG. 2 in response to power from a motor, not shown. Thus, the belt gear 51C, which engages the main body gear 91, rotates counterclockwise in FIG. 2, causing the driven roller 51 and the belt 53 to rotate counterclockwise.

The belt unit 50 includes a handle 57 fixed to a front end of the frame 55. The handle 57 is configured to be grasped when the belt unit 50 is attached to or removed from the main body 10.

Figure 4A:
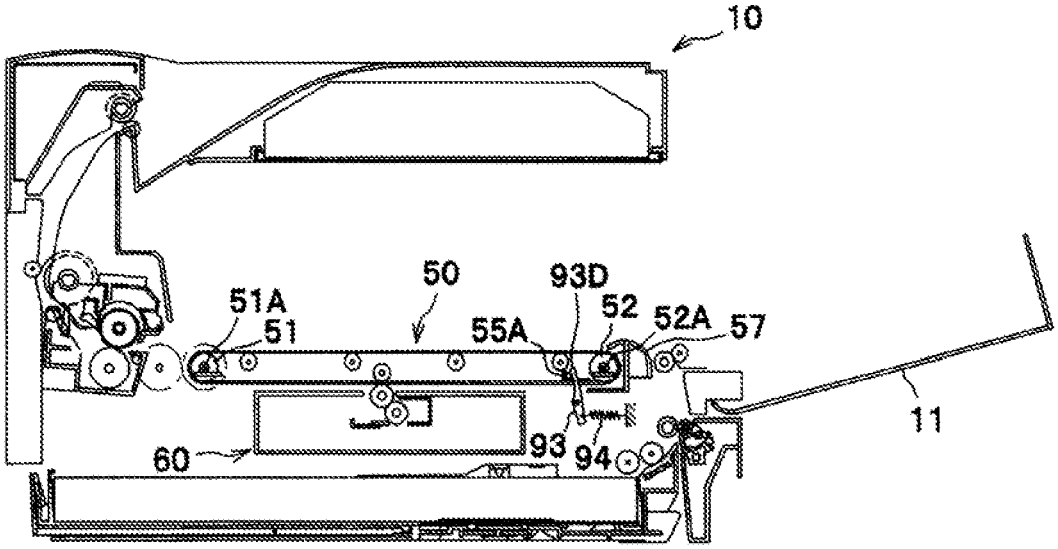
FIGS. 4A and 4B illustrate a process in which the belt unit is removed from a main body.
Figure 4B:
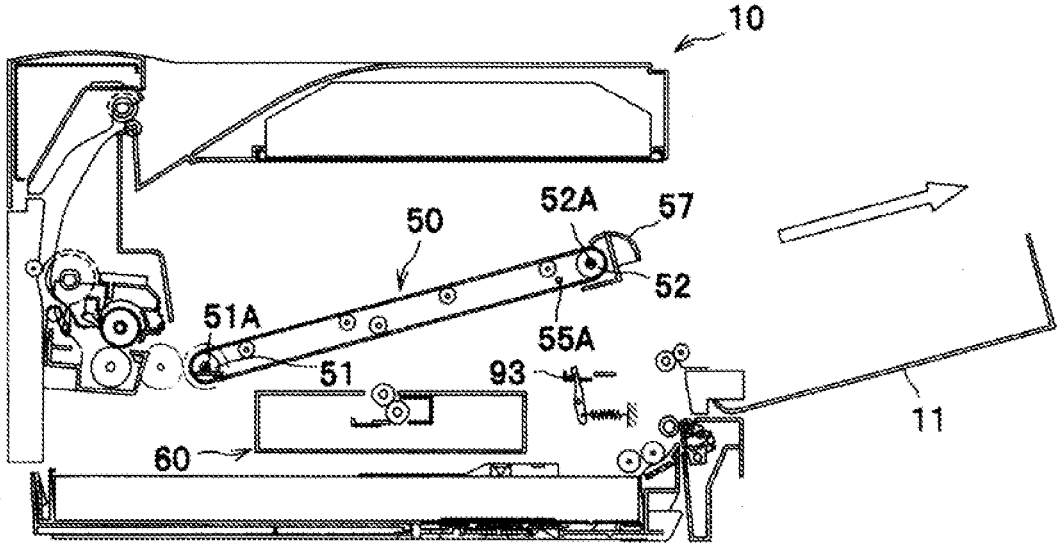

When the belt unit 50 is removed from the main body 10, as shown in FIG. 4A, the front cover 11 is first opened, and then the image forming unit 40 is removed from the main body 10. As shown in FIG. 4B, the handle 57 is grasped and raised, and the belt unit 50 is removed from the main body 10.

As shown in FIGS. 1 and 2, the belt cleaner 60 is disposed below the belt unit 50 or on a side of the belt unit 50 opposite from the image forming unit 40. The belt cleaner 60 is disposed to contact a lower belt 53B of the belt 53 and is configured to remove foreign substances, e.g. toner residue, adhering to the belt 53. The belt cleaner 60 includes a cleaning roller 61, a collecting roller 62, a blade 63 and a collecting box 64.

The cleaning roller 61 is configured to rotate on a shaft, which is parallel to the drive roller 51, in an opposite direction from that of the photosensitive drums 43 or counterclockwise in FIG. 2. The cleaning roller 61 is disposed to contact a lower belt 53B of the belt 53. The cleaning roller 61 is configured to slidingly contact the lower belt 53B and to scrape foreign substances, e.g., toner residue and paper powder, from the outer surface of the belt 53.

A backup roller 56 is disposed on an opposite side of the lower belt 53 from the cleaning roller 61 as a part of the belt unit 50. The backup roller 56 is configured to apply a contact pressure between the cleaning roller 61 and the lower belt 53B.

The collecting roller 62 is disposed below and in contact with the cleaning roller 62. The collecting roller 62 is configured to rotate counter clockwise in FIG. 2 and to remove the foreign substances, e.g., toner residue, adhering to the cleaning roller 61.

The blade 63 is disposed such that its end contacts the collecting roller 62, and is configured to scrape the foreign substances adhering to the collecting roller 62 down to the collecting box 64.

The belt unit 50 and peripheral parts are structured as described above. When printing is started, the photosensitive drums 43, the main body gear 91 and the cleaning roller 61 rotate.

When the photosensitive drums 43 rotate before the belt 53 rotates or the circumferential velocity of the photosensitive drums 43 is faster than that of the belt 53, the photosensitive drums 43 press the upper belt 53A rearward or in the sheet feeding direction via a sheet P. When the circumferential velocity of the photosensitive drums 43 is equal to that of the belt 53, the photosensitive drums 43 do not apply a force to the upper belt 53A. Thus, the rotation of the photosensitive drums 43 does not destabilize the position of the belt unit 50 in the front-rear direction. When the circumferential velocity of the photosensitive drums 43 is faster than that of the belt 53, the position of the belt unit 50 is stabilized more reliably.

As the main gear 91 presses the belt gear 51C downward, a force applied by the main gear 91 to the belt unit 50 in the same direction as the sheet feeding direction is zero. Thus, this force does not cause the destabilization of the position of the belt unit 50 in the front-rear direction.

The cleaning roller 61 is driven by a drive source, which is not shown. When the cleaning roller 61 rotates, the cleaning roller 61 presses the lower belt 53B rearward so as to press the belt unit 50 rearward (in the sheet feeding direction). In other words, a force applied by the belt cleaner 60 to the belt unit 50 in the same direction as the sheet feeding direction is greater than zero. With this force, the lock pins 55A are pressed against the protruding portions 92B so as to stabilize the position of the belt unit 50 in the front-rear direction.

According to the above embodiment, the following effects can be obtained.

The urging force of the lock members 93 has a component in the same direction as the sheet feeding direction. The component of the urging force of the lock member 93 in the same direction as the sheet feeding direction may be greater than half the urging force produced by the lock member 93 and the spring 94. As the lock members 93 urge the belt unit 50 in the same direction as the sheet feeding direction, a force applied from a sheet P to the belt unit 50 can reduce the potential of deformation of the lock members 93.

Forces applied to the belt unit 50 in the same direction as the sheet feeding direction by the belt cleaner 60, the main body gear 91, and the photosensitive drums 43, respectively, are greater than or equal to zero. Thus, the potential of deformation of the lock members 93 can be reduced, and the positioning of the belt unit 50 can be stabilized.

When the photosensitive drums 43 are rotated with a circumferential velocity faster than that of the belt 53, a force is applied to the belt 53 in the same direction as the sheet feeding direction. Thus, the rotation of the photosensitive drums 43 can be also utilized for positioning the belt unit 50.

The main body gear 91 engages the belt gear 51C in such a position that a force with which the main body gear 91 presses the belt unit 50 via the belt gear 51C has a component of the force in the same direction as the sheet feeding direction that becomes zero. Thus, with the force applied from the main body gear 91 to the belt unit 50, the potential of deformation of the lock members 93 can be reduced.

The belt cleaner 60 contacts the belt 53 (53B) on the opposite side of the belt unit 50 from the image forming unit 40. A reactive force of the belt cleaner 60 can be also utilized for positioning the belt unit 50.

The lock pins 55A of the positioning sections 100 are provided to the frame 55. As the frame 55 can be positioned directly in the main body 10, the positioning accuracy of the transfer rollers 54 supported by the frame 55 can be maintained. If a positioning member is provided to a part supported by the frame 55, except for the transfer rollers 54, e.g., the bearings 51A of the drive roller 51, it would adversely affect the positioning accuracy of the transfer rollers 54 supported by the frame 55.

The main body gear 91 and the belt gear 51C are disposed side by side in the direction along the upper belt 53A. Thus, the belt unit 50 can be removed from the main body 10 through a space where the image forming unit 40 has been removed.

Figure 5:
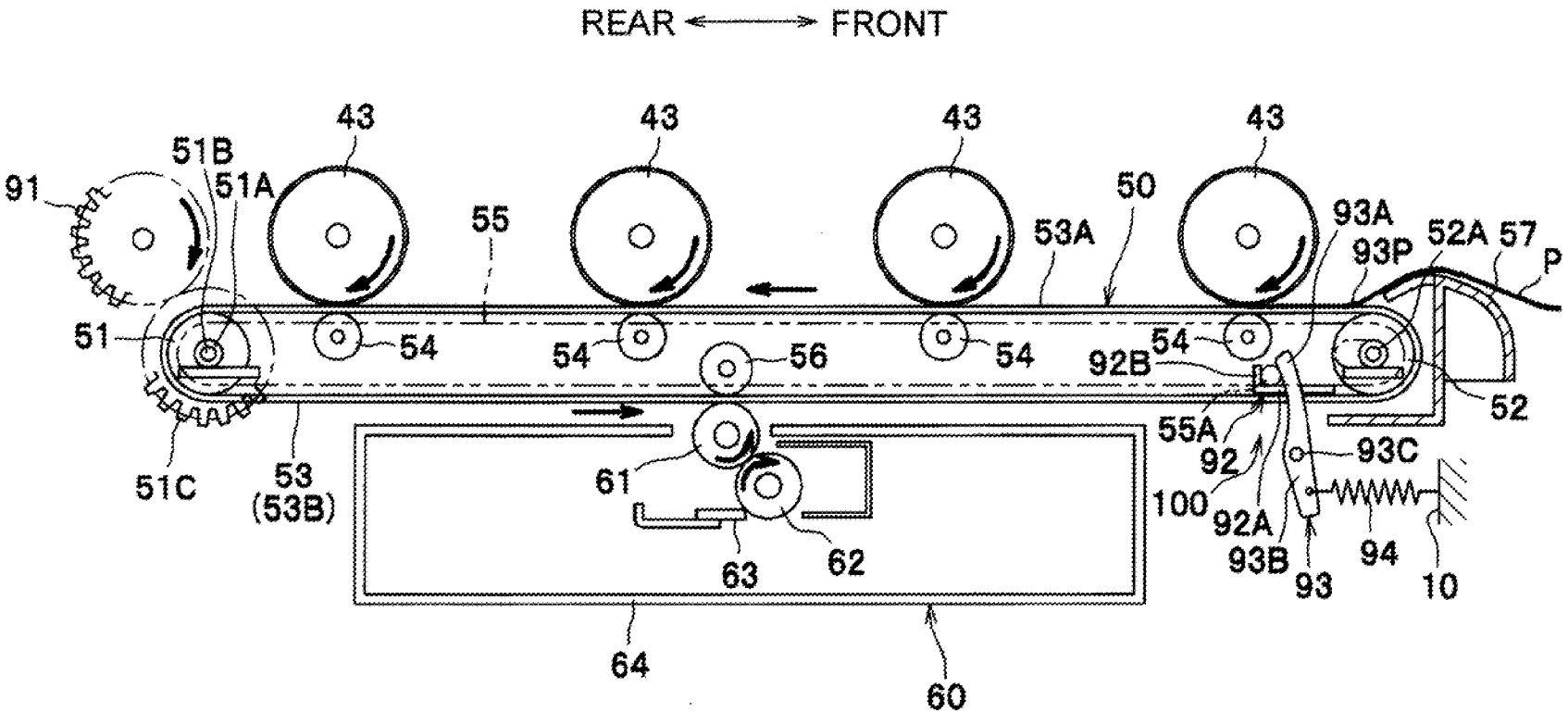
FIG. 5 is a sectional view schematically illustrating a belt unit and peripheral parts according to a modification of the illustrative embodiment.

The above illustrative embodiment shows, but is not limited to, that the force applied by the main body gear 91 to the belt unit 50 in the same direction as the sheet feeding direction is zero as the main body gear 91 and the belt gear 51C are disposed side by side in the direction along the upper belt 53A. For example, as shown in FIG. 5, the main body gear 91 may be disposed diagonally upward behind the belt gear 51C. In this case, a force that the main body gear 91 presses the belt unit 50 via the belt gear 51C has a direction pointing diagonally downward from rear. Also, the force has a component in the same direction as the sheet feeding direction. Thus, this force can be utilized for positioning the belt unit 50. With this arrangement, the force applied by the main body gear 91 to the belt unit 50 in the same direction as the sheet feeding direction becomes greater than zero, and the belt unit 50 can be positioned more stably.

The above illustrative embodiment shows, but is not limited to, the urging member being, for example, the lock member 93 and the spring 94. The lock member 93 and a torsion spring may also be used as the urging member in this embodiment.

The above illustrative embodiment shows, but is not limited to, the force applied by the belt cleaner 60 to the belt unit 50 in the same direction as the sheet feeding direction being greater than zero. In another illustrative embodiment, the force may be zero. For example, the cleaning roller 61 may be disposed to contact the belt 53 in the front-rear direction (sheet feeding direction).

The above illustrative embodiment shows, but is not limited to, the belt cleaner 60 includes the cleaning roller 61 described above. In another implementation, a belt cleaner having a blade that contacts the lower belt 53B may be used.

The above illustrative embodiment shows, but is not limited to, the belt 53 configured to feed a sheet P. The disclosure may be applied to a belt unit of intermediate transfer type in which a developer image formed on a belt is transferred onto a recording sheet. Belt units may include a variety of belt unit types including belt units that convey recording media and belt units that convey developer images to recording media.

The above illustrative embodiment shows, but is not limited to, the positioning rail 92 in which the rail portion 92A and the protruding portion 92B cross each other at right angles. The protruding portion 92B may be inclined frontward such that the rail portion 92A and the protruding portion 92B form an acute angle. In this case, when pressed rearward by the first arm 93A, the lock pin 55A may be subjected to a force acting on both the rail portion 92A and the protruding portion 92B. Thus, the belt unit 50 may be positioned vertically as well as in the front-rear direction.

The above illustrative embodiment shows, but is not limited to, the color printer 1 as an example of an image forming apparatus. The disclosure may apply to a monochrome printer, a copier, and a multifunction apparatus.

The above illustrative embodiment shows, but is not limited to that the belt unit includes the engaging portion and the main body includes the engaged portion. In another implementation, the belt unit may include the engaged portion and the main body may include the engaging portion.

Although an illustrative embodiment and examples of modifications of the present disclosure have been described in detail herein, the scope of the disclosure is not limited thereto. It will be appreciated by those skilled in the art that various modifications may be made without departing from the scope of the disclosure. Accordingly, the embodiment and examples of modifications disclosed herein are merely illustrative. It is to be understood that the scope of the disclosure is not to be so limited thereby, but is to be determined by the claims which follow.

What is claimed is:

1. An image forming apparatus comprising:

a main body including a positioning portion stationary relative to the main body;

a belt unit configured to be attached to and removed from the main body, the belt unit including a belt and a belt supporting mechanism configured to support the belt to be rotatable, the belt supporting mechanism including a roller and a frame supporting the roller, the belt unit further including a contact portion configured to contact the positioning portion of the main body such that the contact portion is positioned by the positioning portion;

an image forming unit configured to form an image on a recording medium, the image forming unit including a plurality of photosensitive drums arranged to contact the belt;

a feeding device configured to feed the recording medium to the belt; and an urging member configured to contact the contact portion positioned by the positioning portion, urge the contact portion of the belt unit in an urging direction, and cause a pressing force to be applied between the contact portion and the positioning portion, wherein the recording medium is fed in a feeding direction between the belt and the photosensitive drums, and wherein the urging direction of the urging member has a component in the feeding direction, wherein, when the belt unit is attached to the main body, the positioning portion stationary relative to the main body and the contact portion of the belt unit are disposed, in the feeding direction, on an upstream side of the belt unit.

2. The image forming apparatus according to claim 1, wherein each of the photosensitive drums is configured to rotate in a forward direction with the belt, and wherein a force applied by each of the photosensitive drums to the belt unit is greater than or equal to zero in the feeding direction.

3. The image forming apparatus according to claim 2, wherein each of the photosensitive drums is configured to rotate with a circumferential velocity faster than a circumferential velocity of the belt.

4. The image forming apparatus according to claim 1, further comprising a belt cleaner disposed to contact the belt and configured to clean a surface of the belt, wherein a force applied by the belt cleaner to the belt unit is greater than or equal to zero in the feeding direction.

5. The image forming apparatus according to claim 4, wherein the belt cleaner contacts the belt on an opposite side of the belt unit from the image forming unit.

6. The image forming apparatus according to claim 1, wherein the belt unit includes a belt gear and a main body gear, wherein the belt gear is disposed at an end of a shaft of the roller and configured to rotate the roller, wherein the main body gear is disposed in the main body and configured to engage the belt gear, and wherein a force applied by the main body gear to the belt unit is greater than or equal to zero in the feeding direction.

7. The image forming apparatus according to claim 6, wherein the main body gear engages the belt gear in a position such that the force applied by the main body gear to the belt unit has a component in the feeding direction.

8. The image forming apparatus according to claim 6, wherein the main body gear and the belt gear are disposed side by side in a direction along a flat surface of the belt.

9. The image forming apparatus according to claim 1, wherein the frame includes the contact portion.

10. The image forming apparatus according to claim 1, wherein the positioning portion includes two surfaces extending in directions crossing each other such that the two surfaces contact the contact portion from different directions.

11. The image forming apparatus according to claim 1, wherein the urging member is configured to press the contact portion toward the positioning portion.

12. The image forming apparatus according to claim 1, wherein the urging member is configured to urge the frame of the belt supporting mechanism.

13. The image forming apparatus according to claim 1, wherein, when the belt unit is attached to the main body, the contact portion of the belt unit is disposed upstream of an axis of a most upstream photosensitive drum of the photosensitive drums.

14. An image forming apparatus comprising:

a main body;

a belt unit configured to be attached to and removed from the main body, the belt unit including a belt and a belt supporting mechanism configured to support the belt to be rotatable, the belt supporting mechanism including a roller and a frame;

an image forming unit configured to form an image on a recording medium, the image forming unit including a plurality of photosensitive drums arranged to contact the belt;

a feeding device configured to feed the recording medium to the belt;

a positioning section including an engaging portion and an engaged portion, the positioning section being configured to position the belt unit when the engaging portion engages the engaged portion; and an urging member configured to contact the engaging portion engaging the engaged portion, urge the belt supporting mechanism of the belt unit in an urging direction, and cause a pressing force to be applied between the engaging portion and the engaged portion, the urging direction of the urging member having a component in a feeding direction, wherein the recording medium is fed in the feeding direction between the belt and the photosensitive drums.

15. The image forming apparatus according to claim 14, wherein the engaging portion is disposed, in the feeding direction, upstream of an axis of a most upstream photosensitive drum of the photosensitive drums.

* * * * *